US006051275A

United States Patent [19]

Lerch et al.

[11] Patent Number: 6,051,275

[45] Date of Patent: Apr. 18, 2000

[54] DOUBLE PORCELAIN-COATED GAS BURNER AND METHOD OF MAKING SAME

[75] Inventors: Allan C. Lerch; Michael E. Tracey, both of Louisville, Ky.

[73] Assignee: Procelain Metals Corporation, Inc., Louisville, Ky.

[21] Appl. No.: 09/093,980

[22] Filed: Jun. 9, 1998

Related U.S. Application Data

[63] Continuation-in-part of application No. 09/031,347, Feb. 26, 1998.

[51] Int. Cl.[7] ..... B05D 1/18; B05D 1/02; B05D 1/36

[52] U.S. Cl. ..... 427/236; 427/239; 427/419.3; 427/427; 427/435; 428/432

[58] Field of Search ..... 427/419.3, 419.4, 427/430.1, 435, 443.2, 427, 374.2, 236, 239; 428/432; 264/214, 215

[56] References Cited

U.S. PATENT DOCUMENTS

| | | |
|---|---|---|
| 2,842,458 | 7/1958 | Feeney et al. . |
| 2,864,721 | 12/1958 | King et al. . |
| 3,922,138 | 11/1975 | Biddle et al. . |
| 3,959,866 | 6/1976 | Biddle et al. . |
| 4,009,302 | 2/1977 | Biddle et al. . |
| 4,519,770 | 5/1985 | Kesselring et al. . |
| 4,828,481 | 5/1989 | Weil et al. . |
| 4,878,837 | 11/1989 | Otto . |
| 4,883,423 | 11/1989 | Holowczenko . |
| 4,889,481 | 12/1989 | Morris et al. . |
| 5,104,309 | 4/1992 | Krieger . |
| 5,147,201 | 9/1992 | Xiong . |
| 5,165,970 | 11/1992 | Schmidt et al. . |
| 5,248,251 | 9/1993 | Betta et al. . |
| 5,368,475 | 11/1994 | Suppiah et al. . |
| 5,455,011 | 10/1995 | Kitto . |

*Primary Examiner*—Fred J. Parker
*Attorney, Agent, or Firm*—Middleton & Reutlinger; James R. Higgins, Jr.

[57] ABSTRACT

A two-step method to porcelain-coat an article is provided particularly useful for porcelain-coating a gas burner used in a gas-fired residential barbecue grill. A gas burner constructed from mild enameling-grade steel is dipped in a slip containing porcelain frit and manipulated so that the slip adequately coats and adheres to the interior surfaces of the burner. The porcelain-containing slip simultaneously coats and adheres to the peripheral "shoulders", and particularly to the interior "shoulders", of the gas jet openings of the burner. A second coating of porcelain-containing slip is then applied, for example, by spraying or other conventional wet application techniques, to the exterior surfaces of the burner. The properties, for example specific gravity, of the porcelain-containing slip of the second wet coating are adjusted for optimal coating properties. Then, the double slip-coated gas burner is fired in a continuous furnace at a peak firing temperature of 1480° F. to 1550° F., with a target of 1530° F.±10° F. for about ten minutes, which adequately bonds the porcelain to the steel gas burner.

64 Claims, 4 Drawing Sheets

DOUBLE PORCELAIN-COATED GAS BURNER AND METHOD OF MAKING SAME

CROSS-REFERENCE TO RELATED APPLICATION

The present invention is a continuation-in-part of, and claims priority from, my pending U.S. patent application Ser. No. 09/031,347 filed Feb. 26, 1998, entitled "Double Porcelain-Coated Gas Burner and Method of Making Same", said Application being incorporated herein by reference.

FIELD OF THE INVENTION

The present invention relates to coating gas burners with a heat-resistant coating, and particularly to providing a double coating of porcelain on gas burners used in residential gas-fired grills, and a method of applying the double porcelain coating to such gas burners.

Residential gas-fired "barbecue" grills have gained wide popularity in recent years as consumers have indicated a purchasing preference for gas-fired grills in increasing numbers over charcoal fired grills. Such gas-fired grills are of well-known construction and usually are provided with a replaceable or rechargeable reservoir of fuel, such as propane, which is fed to a gas burner located within a cooking chamber of the grill. The gas burner is the most failure-prone component of the typical gas-fired grill. First of all, the barbecue grill is often stored outside for long periods of time, thereby subjecting the burner to atmospheric attack in a wide variety of ambient conditions. Further, the combustion characteristics of the gas used in most residential gas grills produce thermal reactions which cause the gas jets to burn out, or cause thermal stresses to appear which crack the burner and render it useless, or even dangerous. Consequently, the average life of a typical gas burner of a gas-fired residential barbecue grill is about two years, or even less.

Heretofore, burners of residential gas-fired barbecue grills have been fabricated of stainless steel. However, because of the above-described harsh environment and combustion characteristics, corrosion causes failure to occur at the gas jet orifices and burner seams. One known method to reduce the thermal damage to gas burners is to porcelain-coat the gas burner, and some attempts have occurred recently to porcelain-coat such burners, for example, by using an electrostatic process. These attempts have increased the life of the gas jet orifices, but have not been successful in protecting the interior surfaces of the combustion chamber of the gas burner. Consequently, the life of a gas burner for residential barbecue grill is still problematically low.

There are several patents in the field of coating gas burners for residential or commercial stoves. However, the teachings of those patents cannot be successfully translated to the particular configurations or ambient operational conditions presented by a typical gas burner for a residential barbecue grill. Indeed, presently-known methods of porcelain coating articles have proven to be inadequate to provide a sufficient porcelain coating on all critical surfaces of the gas burner, including the interior surfaces of the gas combustion chamber, the exterior surfaces of the gas burner and, particularly, the interior peripheries or "shoulders" of the gas jet orifices of the gas burner.

Accordingly, the present invention is a novel method to porcelain-coat a gas burner for a gas-fired residential barbecue grill, and the double porcelain-coated burner made by such method.

SUMMARY OF THE PRESENT INVENTION

Briefly stated, the present invention is a two-step method to porcelain-coat an article, particularly useful in porcelain-coating a gas burner used in a gas-fired residential barbecue grill. First, the gas burner, which due to the present invention may now be made of mild enameling-grade steel, is dipped in a slip containing porcelain frit and manipulated so that the slip adequately coats and adheres to the interior surfaces of the burner. At this same time, the porcelain-containing slip also coats and adheres to the peripheral "shoulders", particularly the interior "shoulders", of the gas jet openings of the burner. Second, a second coating of porcelain-containing slip is applied, for example by spraying or other conventional wet application techniques, to the exterior surfaces of the burner. The properties, for example specific gravity, of the porcelain-containing slip of the second wet coating are adjusted for optimal coating properties. Then, the double slip-coated gas burner is fired in a continuous furnace at a peak firing temperature of 1480° F. to 1550° F., with a target of 1530° F.±10° F. for about ten minutes, which adequately bonds the porcelain to the steel gas burner.

Using this two-step coating process results in a gas burner that has an adequate porcelain coating applied to all critical surfaces of the gas burner, the exterior surfaces, the interior surfaces of the gas combustion area and the interior and exterior "shoulders" of the gas jet orifices. The porcelain coating(s) provided in this manner are thereby resistant to external ambient attack and also to internal thermal attack from the combustion process. This provides a protective surface at a critical failure point of the gas jet, thereby extending, to a surprising degree, the life of a gas burner made according the present invention. For example, whereas the average life of gas burners used in residential gas-fired barbecue grills is about 2 years, more or less, one national manufacturer of residential gas-fired barbecue grills is now offering a limited five-year warranty on porcelain-coated gas burners made according to the present invention.

DETAILED DESCRIPTION OF THE PREFERRED EMBODIMENT

Figures 1, 1A:
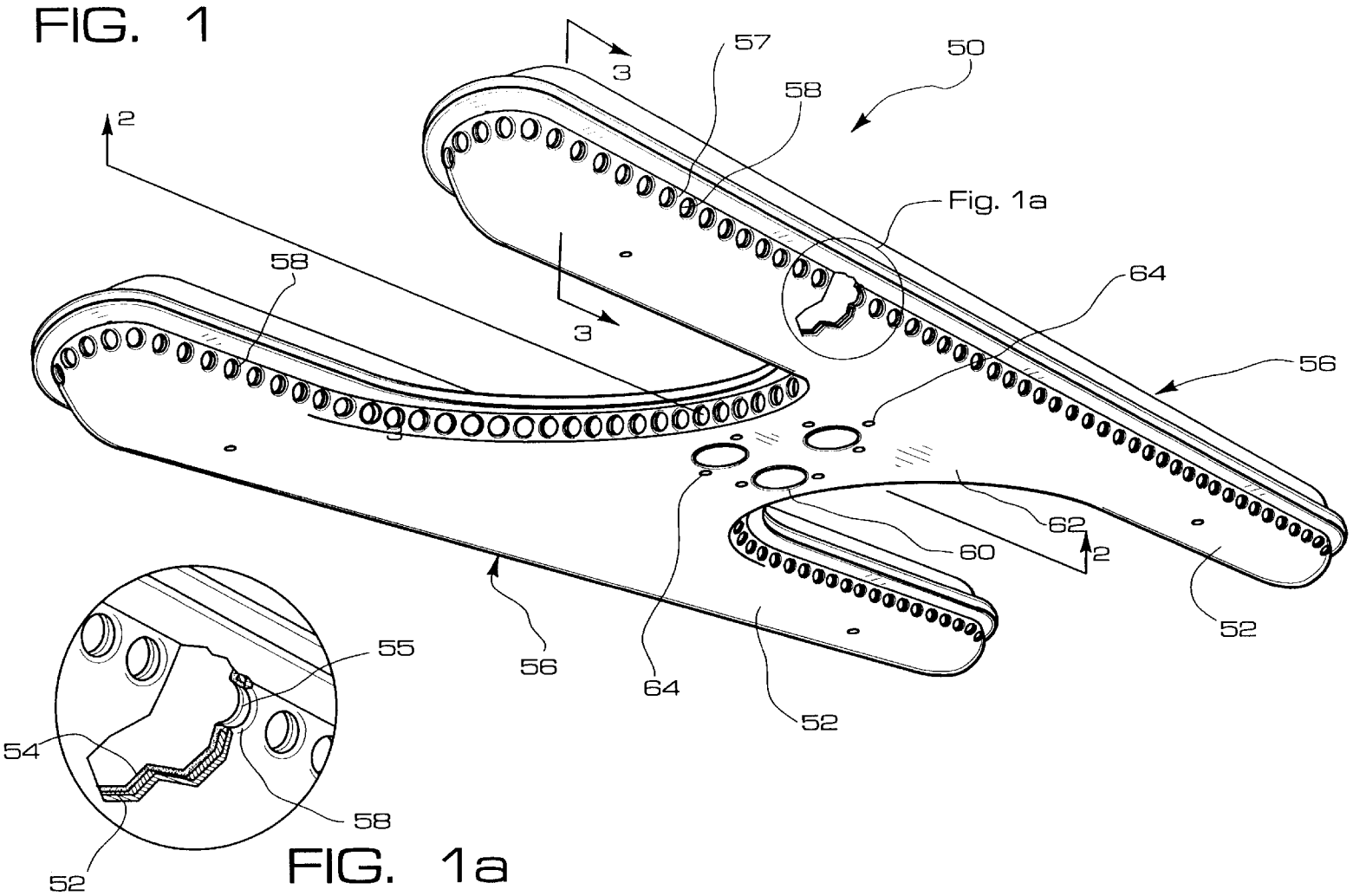
FIG. 1 is a perspective view of a porcelain coated gas burner of the present invention, with a cut-away portion 1*a* revealing the interior thereof.
FIG. 1*a* is an exploded view of a portion of FIG. 1.

Referring now to FIGS. 1, 1*a*, 2 and 3 there is presented a gas burner 50 for use in a gas-fired residential barbecue grill (not shown) made according to the present invention, with an exterior porcelain coating 52 on the exterior surfaces of the burner, and interior porcelain coating 54 on the interior surfaces of the burner, and also a porcelain coating 55 on the interior and exterior "shoulders" 57 of the gas jets 58 of the burner.

Typical gas burners for a residential barbecue grill are presented in a variety of shapes, for example a generally "H-shaped" burner 50, with multiple combustion chambers 56, each combustion chamber 56 having a plurality of gas jet orifices or apertures 58 on the lower portion of the exterior surface 56*e* thereof. The gas burner 50 is mounted by means of mounting surface 62 having mounting apertures 64 therein to receive appropriate fasteners (not shown) to mount the burner 50 in an appropriate cooking position in the grill. Cooking gas, usually propane, is provided from a gas tank (not shown) and fed into the interior 56*i* of each combustion chamber 56 through at least one gas inlet port 60 in the mounting surface 62. The cooking gas is ignited within the interiors 56*i* of combustion chambers 56, and gas flames (not shown) emit through the orifices 58 of combustion chambers 56 to provide a row of cooking heat to the gas grill.

Figure 2:
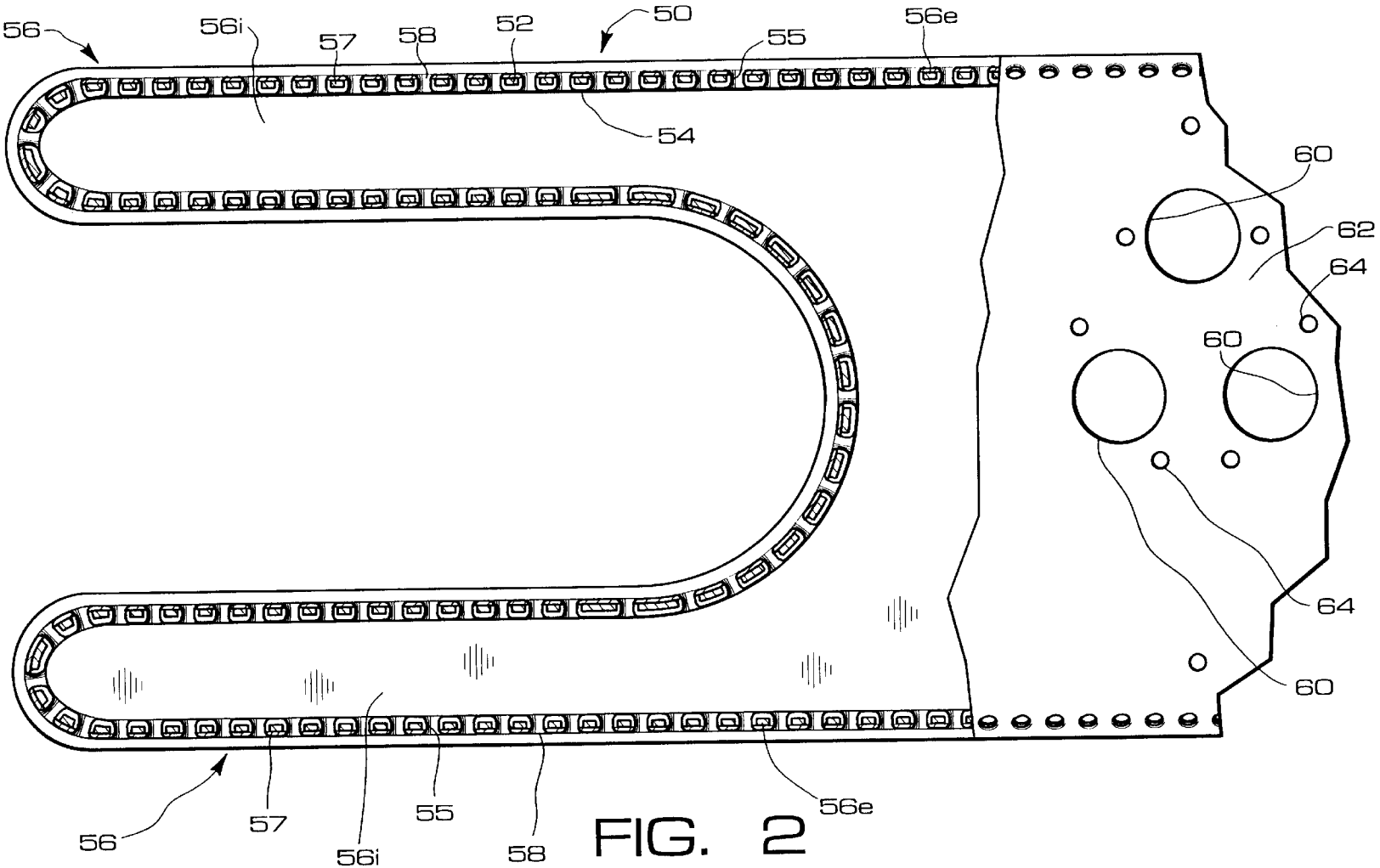
FIG. 2 is a cross-sectional view of the gas burner, taken along line 2—2 of FIG. 1.
Figure 3:
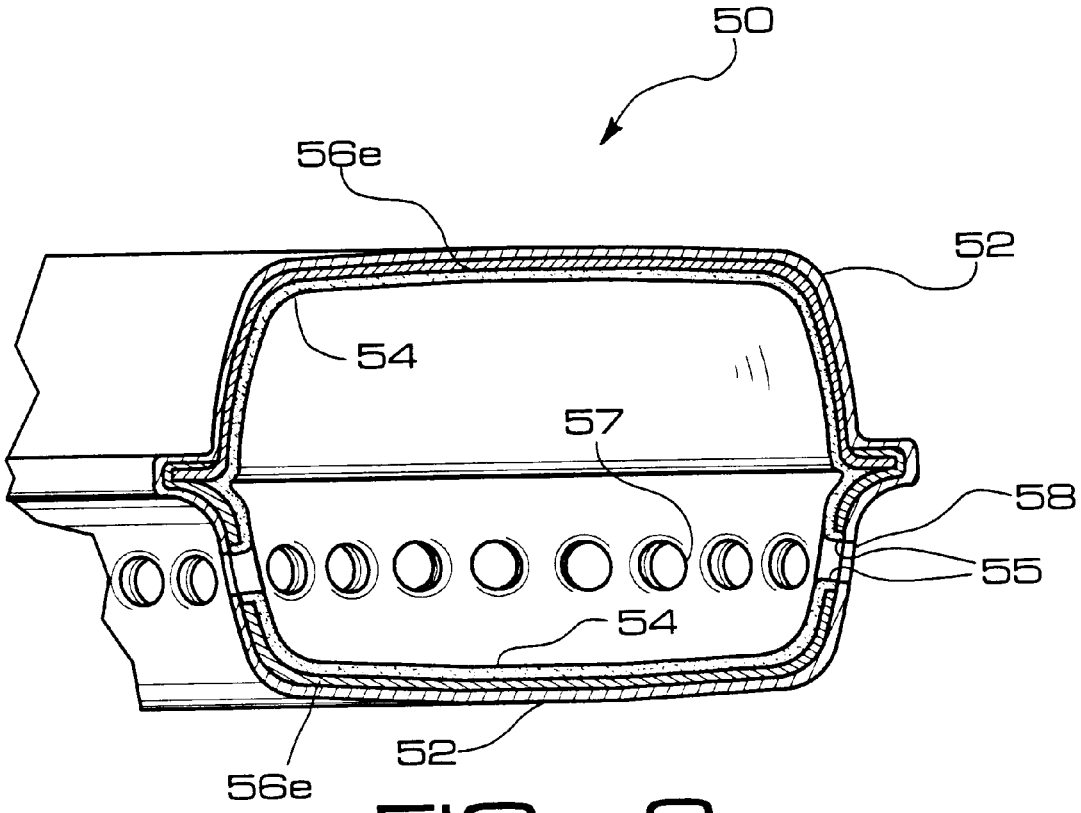
FIG. 3 is a cross-sectional view of the gas burner, taken along line 3—3 of FIG. 1; and, FIG. 4 is a Flow Chart of the Steps of the Preferred Embodiment of present invention.

Examination of the cut-away portion of FIGS. 1, 1*a*, as well as FIGS. 2 and 3, reveals that an interior porcelain coating 54 is provided on the interior surfaces of the burner. A key feature of the gas burner made according to the method of the present invention is that an adequate porcelain coating 55 is provided on both the interior and exterior peripheral "shoulders" 57 of the gas jet orifices 58.

Figure 4:
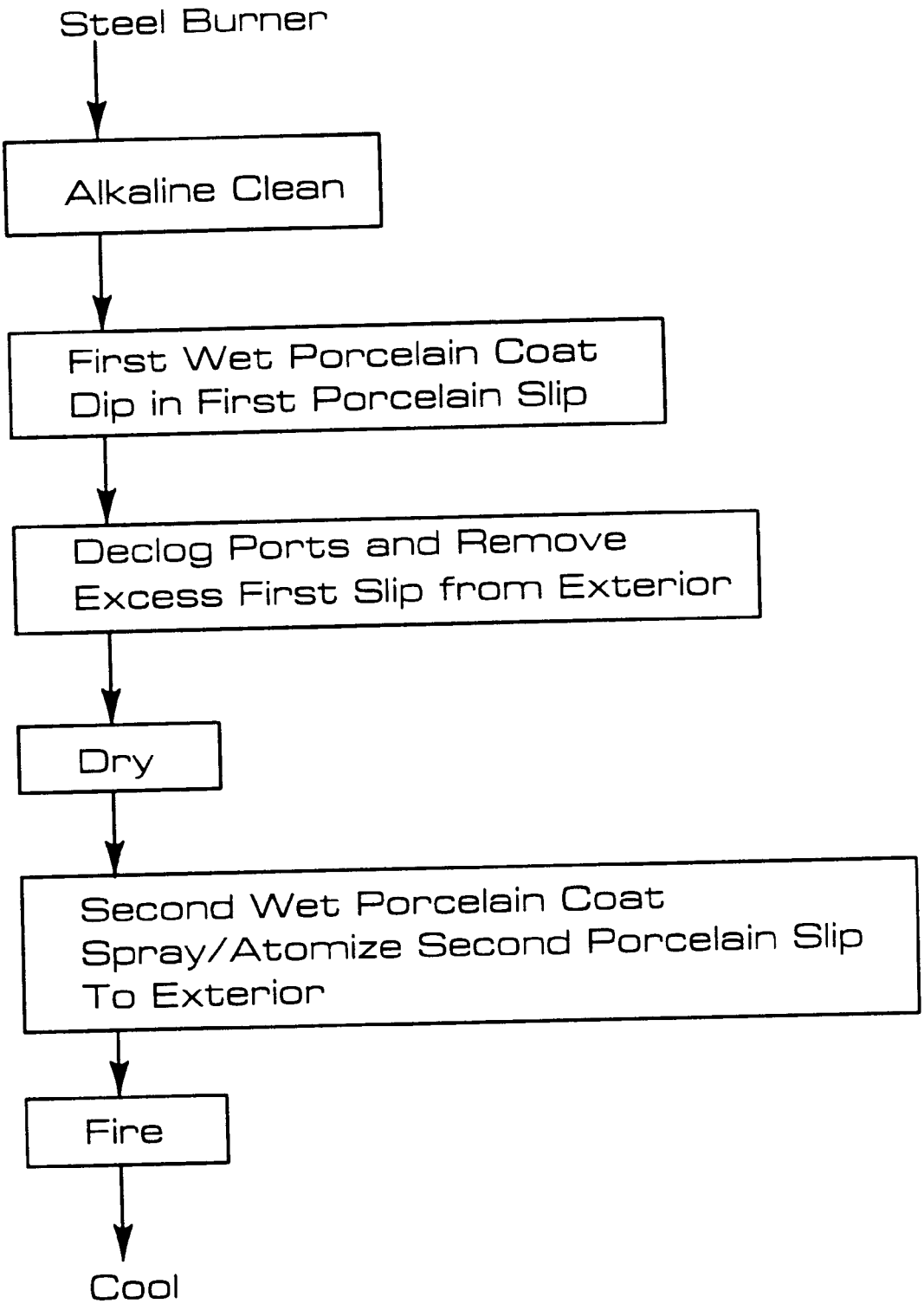

Referring additionally to FIG. 4 shows the preferred process steps to make the porcelain-coated gas burner 50 of the present invention. First, the raw, uncoated gas burner 50, which can now be made of enameling grade steel, is pressure washed with an alkaline cleaner to remove mill oils, drawing compounds and other residue from the surfaces of the steel. While any number of alkaline cleaners would be adequate, we have found that a cleaner "TEXOLITE MAC" available from Texo, Inc. of Cincinnati, Ohio performs satisfactorily.

Next, the washed uncoated burner 50 is dipped into a relatively thin porcelain frit slurry. The slurry is made according to conventional wet porcelain practices. While any number of wet porcelain frit slurries would likely produce acceptable results, we have found the following formulation to produce satisfactory results:

TABLE I

| General Composition of Porcelain Wet Coat for Slip | |
|---|---|
| Glass frits | 90–100% |
| Clays | 0–10% |
| Electrolytes | 0–0.5% |
| Oxides | 0–1.0% |

A particular formulation of first wet coat that has provided satisfactory results is:

TABLE II

| Charge of Wet Porcelain Slip | |
|---|---|
| 100 lbs | Mixture of 3 ground coat frits |
| 8 lbs | Mixture of 3 clays |
| 0.5 lbs | Mixture of 4 electrolytes |
| 50 lbs | Water |

The ground coat frits utilized in the above formulation are Nos. 10506, 10508 and 10509 purchased from CV Materials, Ltd. of Urbana Ohio. The clays utilized are M-79 and M-16 grade clays, plus bentonite purchased from Pemco Corp. of Baltimore Md. The electrolytes used in the above formulation are boric acid, sodium aluminate, potassium carbonate and 2-2600 "Set-It HK ". The boric acid, sodium aluminate and potassium carbonate are commercially available from a number of suppliers, and S-2600 "Set-It HK" is available from Pemco. In some cases, in addition to the above materials, it may be desirable to use tris nitro available from Pemco, or the like, to kill bacteria present in some waters. When we use such material, we use about 4–7 grams per 100 pounds in the above total charge of Table II.

It is known that the oxides of the above formulation are generally used to provide color to the porcelain coat. At present, we want the finished porcelain coat to be black, so we use five pounds of G635 or G621 black oxide available from Pemco in the total charge of Table II.

The foregoing ingredients are mixed with water in a standard wet ball mill containing high density alumina balls of 1" to 3" diameter and milled for approximately 3.5 hours, or until only about 6–8% of solids are retained on a 200 mesh (U.S. Series) screen. When emitted from the ball mill, the ball-milled slip has a specific gravity of about 1.7, but is adjusted in a known manner to a specific gravity of about 1.59 to about 1.66, preferably about 1.63. This lower specific gravity is important, as is explained more fully below.

It is important that the wet coat porcelain slip be of a lower than normal specific gravity, in the range of about 1.59 to about 1.66. The lower specific gravity slip permits the slip to coat virtually all the interior surfaces 56*i* of the combustion chambers 56 of the gas burner, including the providing a porcelain coating 55 on the interior shoulders 57 of the gas jet orifices 58 of the combustion chambers 56. At present, we have found that a slip of a specific gravity of about 1.63 produces the best results. Also at present, we hand dip the cleaned raw burner 50 into the low specific gravity slip, including manipulating the burner to ensure maximum coating of the porcelain slip on the interior surfaces 54 and shoulders 55, produces the best results. Using the lower specific gravity slip produces a "pick up" rate of about 6 to about 14 grams per square foot of surface area, which results in a fired porcelain coating in the range of about 1.5 mils to about 2.5 mils on the interior surfaces 54 of the burner 50. We are confident that an appropriate automated dipping process would produce acceptable results, so long as the specific gravity of the wet coat slip were maintained within the above range or at the preferred specific gravity and the burner 50 were manipulated to provide target coating pick up thicknesses set forth herein.

After the burner 50 has been dipped into the low specific gravity wet coat slip, the exterior of the wet-coated burner 50 is cleaned with an air knife to ensure that the gas jet orifices 58 are not clogged, but at the same time that a sufficient shoulder coating 55 of wet coat slip remains on the periphery or shoulders 57 of the gas jet orifices 58. Then excess wet coat slip is removed from the exterior of the coated burner 50.

Next, the de-clogged burner 50 with excess slip removed (but with wet coat porcelain still coated on the interior 54 including with a retained shoulder/periphery coating 55 on the shoulders 57) is dried for about 5 to 8 minutes in a forced-air dryer at about 400° F., sufficient to present the exterior surfaces to receive a second sprayed-on slip coat of porcelain. An infrared dryer could also be used, and it would likely require a shorter drying time.

The spray coat used in the present invention is an adjusted version of the same slip as used in the first, hand-dipped, coat, with the properties adjusted for optimal coating of the exterior surfaces of burner 50. The slip is adjusted to a specific gravity of about 1.67 to 1.74 to achieve a wet pick-up of about 35–45 gm/ft$^2$, with a preferred specific gravity of about 1.69 to achieve a wet pick-up rate of about 40 gm/ft$^2$. Wet pick-up rate can be adjusted by adding setting agents, such as potassium nitrate available from CV Materials or Pemco, or "Pyro" (pyro tetrasodium phosphate) also available from CV Materials or Pemco, to the slip, which adds "set" to the slip so as to achieve the target pick-up rate. At the preferred specific gravity and pick-up rate (1.69/40), the sprayed on coating will be about 6 to 9 mils thick, which in turn will achieve a fired coating thickness of about 4 to 6 mils. The spray-on slip is hand-sprayed onto the exterior surfaces of the burner 50 in an understood manner, from a tank of the adjusted second slip pressurized at about 60±10 p.s.i., to produce a fired thickness of about 4 to about 6 mils. Exterior fired-on spray-coatings of less than about 2.0 mils will tend to burn off, while wet coatings greater than 6 mils will have a tendency to spall, both of which could separately lead to premature failure of the burner 50.

The hand wet-coated and spray-coated burner 50 is then fired in a continuous furnace to a peak temperature of about 1480° F. to about 1550° F., with a preferred peak firing temperature of 1530° F.+10° F., for about five minutes a peak temperature. As is generally understood in the porcelain enameling industry, in a continuous furnace, to-be-fired articles (e.g., the hand wet-coated and spray-coated burners 50) are suspended by hooks or the like from a heat-resistant wire or chain which traverses the length of the furnace. The furnace contains heating zones of different temperatures throughout the traversed length of the furnace, such that the temperature of entrance of the furnace is generally at ambient temperature and zones of increased temperature are provided including a peak temperature firing zone, followed by zones of decreased temperature until the exit portions of the furnace are generally at ambient temperature. In the present invention, the firing cycle is such that the double-coated burners 50 traverse through the furnace at a line speed of about 10–20 feet per minute, such that the double-porcelain coated gas burners 50 are exposed to the peak firing temperature for about five minutes.

The firing of the double-coated burner 50 thermally bonds the porcelain to the steel in a well-understood manner, with the result that the finished porcelain-coated gas burner 50 has adequate porcelain coating on the exterior surfaces 52, the interior surfaces 54 and the shoulder or peripheral surfaces 55.

While in the foregoing specification this invention has been described in relation to specific preferred embodiments thereof, and many details have been set forth for the purpose of illustration, it will be apparent to those skilled in the art that the details are provided only by way of example, and the invention is not intended to be limited to the specific embodiments set forth herein, but rather is susceptible to additional embodiments, and that certain of the details described herein can be varied considerably without departing from the basic principles or scope of the invention.

Having thus described the invention with the detail and particularity required by the Patent Laws, what is desired to be protected by Letters Patent is set forth in the following appended claims.

We claim:

1. A method of coating an article having orifices therein with heat resistant porcelain material on its interior and exterior surfaces, comprising the steps of:

providing an article having apertures therein to be coated;

providing a first porcelain-containing aqueous slip;

immersing said article in said slip to coat the interior and exterior surfaces and the peripheral shoulders of said orifices;

removing excess slip from said apertures and said exterior surface while retaining a coating of said porcelain-containing slip on the shoulders of said orifices;

applying a second porcelain-containing slip coating to said exterior surface and to said shoulders of said orifices;

firing said article at sufficient temperatures to thermally bond the porcelain of said first porcelain-containing slip to said interior surfaces, and thermally bond the porcelain of said second porcelain-containing slip to said exterior surfaces, and also provide a thermal bonded porcelain coating around said shoulders of said orifices to form a porcelain-coated article.

2. The method of claim 1 when said article to be coated is a gas burner.

3. The method of claim 2 wherein said gas burner is comprised of enameling grade steel.

4. The method of claim 3 including the additional step of alkaline cleaning said steel gas burner prior to immersing same in said first porcelain-containing slip.

5. The method of claim 4 wherein said first porcelain-containing slip comprises glass frit of about 90 to about 100%, clays of about 0 to about 10%, electrolytes of about 0 to 0.5 percent and oxides of about 0 percent to about 0.1 percent mixed in water and is provided at a specific gravity in the range of about 1.59 to about 1.66.

6. The method of claim 4 wherein said first porcelain-containing slip comprises glass frit of about 90 to about 100%, clays of about 0 to about 10%, electrolytes of about 0 to 0.5 percent and oxides of about 0 percent to about 0.1 percent mixed in water and is provided at a specific gravity in the range of about 1.59 to about 1.66 is provided at a specific gravity of about 1.63.

7. The method of claim 4 wherein said coating of said first porcelain-containing slip on the interior surfaces of said gas burner is provided at a pickup rate in the range of about 6 to about 14 grams per square foot.

8. The method of claim 4 wherein said coating of first said porcelain-containing slip on the interior surfaces of said gas burner is provided at a pickup rate in the range of about 9 grams per square foot.

9. The method of claim 4 wherein said coating of first said porcelain-containing slip is provided on the interior surfaces of said burner at a fired thickness in the range of between 1.5 mils to about 2.5 mils.

10. The method of claim 4 wherein said second porcelain-containing slip is sprayed onto said exterior surfaces of said burner to produce a fired thickness in the range of between 2.5 to about 6.0 mils.

11. The method of claim 4 wherein said firing occurs at a peak temperature in the range of about 1480° F. to about 1550° F.

12. The method of claim 4 wherein said firing occurs at a peak temperature in the range of about 1520° F. to about 1540° F.

13. The method of claim 4 wherein said firing occurs at a peak temperature of about 1530° F.

14. The method of claim 4 wherein said firing occurs in a continuous furnace, wherein said coated articles are traversed through said furnace while suspended from a traveling line which travels through said furnace at a speed of about 10 to about 20 feet per minute, whereby said coated burners are subjected to the peak firing temperature for about five minutes.

15. A method of coating an article having interior surfaces, exterior surfaces, and orifices therein with heat resistant porcelain material comprising the steps of:

a) providing a first aqueous solution with a specific gravity in the range of 1.59 to 1.66 containing a first heat resistant porcelin material;

b) immersing an article having orifices therein to be coated in said first aqueous solution so as to provide a selected pick-up coating of said first aqueous solution on the interior and exterior surfaces of said article, and on surfaces of said orifices;

c) removing any excess of said first aqueous solution from and drying the exterior surface of said article;

d) spraying a second aqueous heat-resistant porcelain material with a specific gravity in the range of 1.67 to 1.74 onto the exterior surface of said article;

e) subjecting said article containing said first heat-resistant porcelain material and said second heat-resistant porcelain material to a temperature in the range of 1480° F. to 1550° F. to thermally bond said first and second heat-resistant porcelain materials to said article; and f) cooling said thermally bonded article to form a porcelain coated article having porcelain coating on the interior surfaces, exterior surfaces, and shoulder surfaces of said orifices.

16. The method of claim 15 including the additional step of alkaline cleaning said article prior to immersing it in said first aqueous solution.

17. The method of claim 16 wherein said article is a steel gas burner.

18. The method of claim 17 wherein said first heat resistant porcelain material is a porcelain-containing slip comprised of 90 to 100 percent glass frit, 0 to 10 percent clays, 0 to 0.5 percent electrolytes and 0 to 0.1 percent oxides mixed in water resulting in a specific gravity of said slip of between 1.59 and 1.66.

19. The method of claim 17 wherein the selected pickup of said first aqueous heat-resistant porcelain material on said interior surfaces is in the range of about 6 to 14 grams per square foot.

20. The method of claim 17 wherein said second heat-resistant porcelain material is a porcelain-containing slip sprayed onto said exterior surfaces to produce a fired thickness of about 1.5 mils to about 6 mils.

21. The method of claim 17 wherein said selected elevated temperature is in the range of about 1540° F.

22. The method of claim 17 wherein said burner is subjected to peak elevated temperature for about five minutes.

23. The method of claim 17 wherein said porcelain is thermally bonded to said interior surfaces and said exterior surfaces and said periphey of said shoulders of said orifices of said burner.

24. A method of porcelain coating the interior and exterior surfaces and orifices of a steel gas burner comprising the steps of:

a) providing a pre-formed steel gas burner having orifices therein;

b) alkaline washing said gas burner to clean the surfaces of said gas burner;

c) providing a first porcelain-containing slip of specific gravity in the range of about 1.59 to about 1.66, said slip comprising about 90 to about 100 percent gas frit, about 0 to about 10 percent clays, about 0 to about 0.5 percent electrolytes and about 0 to 1.0 percent oxides mixed in water;

d) hand dipping said alkaline-washed gas burners in said slip and manipulating said burner in said slip so as to provide a coating of said first slip on peripheral shoulders of said orifices and the interior surfaces of said gas burner of a fired thickness in the range of about 1.5 to about 2.5 mils;

e) removing excess slip from the orifices of said gas burner, leaving said slip coated on the peripheral shoulders of said orifices;

f) removing excess slip from the exterior surfaces of said burner and drying said exterior surfaces;

g) spraying a second porcelain-coating slip of second selected specific gravity to said dried exterior surfaces of said gas burner to provide a fired thickness of about 2.5 to about 6 mils; and h) firing the coated and sprayed burners in a continuous furnace, wherein said coated and sprayed burners are suspended on a line traveling through said furnace at a line speed of about 20 feet per minute and where the coated and sprayed burners are subjected to a peak firing temperature of about 1520° F. to about 1540° F. for about five minutes to thermally bond said porcelain of said first porcelain-coating slip and said second porcelain-containing slip to said interior surfaces and said exterior surfaces and said periphral shoulders of said orifices of said burner to form a porcelain coated steel gas burner.

25. A method of porcelain coating a steel gas burner having interior and exterior surfaces, and orifices therein, comprising the steps of:

a) dipping the burner in a first porcelain-containing slip of a specific gravity in the range of 1.59 to 1.66 to coat at least the interior surfaces and shoulders of said gas jet orifices with porcelain slip;

b) applying a coating of a second porcelain-containing slip of a specific gravity in the range of 1.67 to 1.74 to the exterior surfaces of said burner; and c) firing said first slip-coated interior surfaces, said first slip-coated shoulders and said second slip-coated exterior surfaces to thermally bond said porcelain to said interior surfaces, said peripheries and said exterior surfaces to form a porcelain coated steel gas burner.

26. The method of claim 25 wherein said selected specific gravity of said first porcelain-containing slip is about 1.63.

27. The method of claim 25 wherein said first porcelain-containing slip is applied to said interior surfaces to provide a fired thickness of about 1.5 to 2.5 mils.

28. The method of claim 25 wherein said coating of said second porcelain-containing slip is applied to said exterior surfaces in a fired thickness of about 2.5 to 6 mils.

29. The method of claim 25 wherein said burner containing said applied first porcelain-containing slip and said second porcelain-containing slip is fired at a peak temperature of about 1480° F. to about 1550° F. for about five minutes.

30. The method of claim 25 wherein said burner containing said applied first porcelain-containing slip and said second porcelain-containing slip is fired at a peak temperature of about 1520° F. to about 1540° F. for about five minutes.

31. The method of claim 25 wherein said burner containing said applied first porcelain-containing slip and said second porcelain-containing slip is fired at a peak temperature of about 1530° F. for about five minutes.

32. A method of porcelain-coating a steel gas burner having interior and exterior surfaces and gas jet orifices therein, comprising the steps of:

a) dipping the burner in a first porcelain-containing slip of a specific gravity between about 1.59 to about 1.66 to coat at least the interior surfaces to a fired thickness of about 1.5 to about 2.5 mils and also to coat the peripheries of said gas jet orifices with said first porcelain-containing slip;

b) applying a coating of a second porcelain-containing slip to the exterior surfaces of said burner in a fired thickness of about 2.5 to about 6 mils; and c) firing said first slip-coated interior surfaces, said first slip-coated orifice peripheries and said second slip-coated exterior surfaces in a continuous furnace to a peak temperature of between about 1480° F. to about 1550° F. for about five minutes to thermally bond said porcelain to said interior surfaces, said peripheries and said exterior surfaces to form a porcelain coated steel gas burner.

33. A porcelain coated article made according to the method of claim 1.

34. A porcelain coated article made according to the method of claim 2.

35. A porcelain coated article made according to the method of claim 3.

36. A porcelain-coated gas burner made according to the method of claim 4.

37. A porcelain-coated gas burner made according to the method of claim 5.

38. A porcelain-coated gas burner made according to the method of claim 6.

39. A porcelain-coated gas burner made according to the method of claim 7.

40. A porcelain-coated gas burner made according to the method of claim 8.

41. A porcelain-coated gas burner made according to the method of claim 9.

42. A porcelain-coated gas burner made according to the method of claim 10.

43. A porcelain-coated gas burner made according to the method of claim 11.

44. A porcelain-coated gas burner made according to the method of claim 12.

45. A porcelain-coated gas burner made according to the method of claim 13.

46. A porcelain-coated gas burner made according to the method of claim 14.

47. A porcelain coated article made according to the method of claim 15.

48. A porcelain coated article made according to the method of claim 16.

49. A porcelain coated gas burner made according to the method of claim 17.

50. A porcelain coated gas burner made according to the method of claim 18.

51. A porcelain coated gas burner made according to the method of claim 19.

52. A porcelain coated gas burner made according to the method of claim 20.

53. A porcelain coated gas burner made according to the method of claim 21.

54. A porcelain coated gas burner made according to the method of claim 22.

55. A porcelain coated gas burner made according to the method of claim 23.

56. A porcelain coated steel gas burner made according to the method of claim 24.

57. A porcelain coated steel gas burner made according to the method of claim 25.

58. A porcelain coated steel gas burner made according to the method of claim 26.

59. A porcelain coated steel gas burner made according to the method of claim 27.

60. A porcelain coated steel gas burner made according to the method of claim 28.

61. A porcelain coated steel gas burner made according to the method of claim 29.

62. A porcelain coated steel gas burner made according to the method of claim 30.

63. A porcelain coated steel gas burner made according to the method of claim 31.

64. A porcelain coated steel gas burner made according to the method of claim 32.

* * * * *